US009073740B2

(12) United States Patent
Beyers et al.

(10) Patent No.: US 9,073,740 B2
(45) Date of Patent: Jul. 7, 2015

(54) FILLING VALVE

(71) Applicant: Filmatic Packaging Systems (Pty) Ltd, Huguenot (ZA)

(72) Inventors: Daniel Scholtz Beyers, Huguenot (ZA); Johannes Albertus Loubser Beyers, Huguenot (ZA)

(73) Assignee: Filmatic Packaging Systems (Pty) Ltd, Huguenot (ZA)

( * ) Notice: Subject to any disclaimer, the term of this patent is extended or adjusted under 35 U.S.C. 154(b) by 185 days.

(21) Appl. No.: 13/774,545

(22) Filed: Feb. 22, 2013

(65) Prior Publication Data

US 2014/0239216 A1 Aug. 28, 2014

(51) Int. Cl.
*B67C 3/26* (2006.01)

(52) U.S. Cl.
CPC ..... *B67C 3/2608* (2013.01); *B67C 3/2611* (2013.01); *B67C 3/2637* (2013.01)

(58) Field of Classification Search
CPC .... B67C 3/2608; B67C 3/2637; B67C 3/2611
USPC ..... 251/335.3; 141/290, 291, 308, 309
See application file for complete search history.

(56) References Cited

U.S. PATENT DOCUMENTS

| | | | | | |
|---|---|---|---|---|---|
| 2,499,149 | A | * | 2/1950 | Lippold | 141/117 |
| 2,711,279 | A | * | 6/1955 | Day et al. | 141/55 |
| 2,716,517 | A | * | 8/1955 | Tollberg | 141/117 |
| 3,416,577 | A | * | 12/1968 | Franz | 141/117 |
| 3,460,590 | A | * | 8/1969 | Robbins | 141/7 |
| 4,825,914 | A | * | 5/1989 | Leininger | 141/59 |

* cited by examiner

*Primary Examiner* — William McCalister
*Assistant Examiner* — Ian Paquette
(74) *Attorney, Agent, or Firm* — Fennemore Craig, P.C.

(57) ABSTRACT

The invention discloses a valve including a valve body with a valve inlet and a valve outlet. The valve body is joined to a bellows between the valve inlet and the valve outlet, the bellows having an annular side wall formed in a concertina formation with inner and outer corners wherein the side wall has a non-constant thickness along its length, the side wall being thicker at the outer corners and thinner at the inner corners. The bellows further has an annular mounting base for attachment to the valve body. The valve body has an annular flange from which extends an upstanding collar, wherein the mounting base is clamped between the valve body and the collar. The mounting base has a width being wider than a gap formed between the valve body and the collar so that the mounting base is compressed when clamped between the valve body and the collar.

21 Claims, 5 Drawing Sheets

FILLING VALVE

FIELD OF INVENTION

The present invention relates to a filling valve.

More particularly, the present invention relates to a filling valve for an automatic level filling machine that can be cleaned in place without requiring dismantling.

BACKGROUND TO INVENTION

An automatic level filling valve used in a rotary level filling machine allows a container to be filled with a product to a preset level. The filling valve has two concentric tubes with an outer tube surrounding an inner tube so that the outer tube can slide longitudinally along the inner tube. A first or product passage is provided for allowing product to flow into the container, which product passage can either be formed within the first inner tube or as a recess on the outer periphery of the inner tube. A second or vent passage for venting air from the container during a filling operation extends longitudinally through the inner tube.

The outer tube is joined to and supported by a compressible bellows. In a rest position of the filling valve, the outer tube is biased by the compressible bellows to close off both the product and vent passages.

During operation, when the tubes are inserted into the container, the container presses against a part of the outer tube to counteract the bias of the bellows—thereby causing the outer tube to slide along the inner tube to open the product and vent passages. This allows the product to flow through the product passage into the container while air in the container is displaced by the product and vented through the vent passage.

The level to which the container is filled is determined by the distance that the outer tube is inserted into the container. The filling operation automatically stops after the product level in the container rises sufficiently to cover and close off the vent passage, because the air in the container is trapped and can no longer be vented through the vent passage.

The pressure exerted on the product in the container at this stage is dependent on and a function of the head of fluid or liquid provided in a filling bowl above the filling valve. This pressure often results in the container volume increasing slightly because of swelling under pressure, which can be quite significant for more flexible containers. Subsequently, as the container is removed from the valve, the valve is closed and the pressure head removed from the container. This results in a "contraction" of the container when returning to its normal shape and a corresponding decrease in container volume, often leading to some of the product in the container being ejected through its mouth.

The pressure head can also cause some of the product to leak out between the outer tube and the bellows due to the product flowing through the bellows before entering the product passage.

In order to maintain hygiene, particularly when the product being filled is for consumption, the valve must be regularly cleaned. Ideally, to improve production time, the valve should be cleaned in place on the filling machine. In filling machines not having a bellows, the cleaning is done by flushing the valve with cleaning fluid in a reverse direction to the normal filling operation. However in valves with regular bellows (i.e. having a constant side wall thickness), this is not possible due to the bellows being "concertinaed" when opened. Some product is thus trapped within the folds of the bellows side wall, which prevents proper cleaning. Thus such valves need to be removed from the filling machine and dismantled to be properly cleaned.

It is an object of the invention to suggest a valve, which will assist in overcoming these problems.

SUMMARY OF INVENTION

According to the invention, a valve includes a valve body with a valve inlet and a valve outlet; a bellows being joined at one end externally to the valve body between the valve inlet and the valve outlet; wherein the bellows has an annular side wall formed in a concertina formation with inner and outer corners and wherein the side wall has a non-constant thickness along its length, the side wall being thicker at the outer corners and thinner at the inner corners.

The bellows may be adapted to be compressed during which major deformation of the concertina formation occurs at the inner corners, while restricted deformation of the concertina formation occurs at the outer corners.

The side wall may have an inner surface and wherein, during compression of the bellows, no part of the inner surface comes into contact with any other part of the inner surface.

The side wall may have a substantially rectangular shape outwardly of the outer corners when seen in vertical cross-section.

The side wall may be adapted to prevent compression of the bellows beyond a pre-selected degree.

The valve may include a plug located transversally inside the bellows, the plug being adapted to seal against the side wall when the bellows is fully expanded or partially compressed and the plug further being adapted to be spaced apart from the side wall when the bellows is compressed by more than 40%.

The plug may be a circular disc.

The plug may be adapted to seat against an inner corner of the concertina formation.

The bellows may have an annular mounting base for attachment to the valve body; and the valve body has an annular flange from which extends an upstanding collar, wherein the mounting base is clamped between the valve body and the collar.

The mounting base may have a width being wider than a gap formed between the valve body and the collar, thereby to compress the mounting base when clamped between the valve body and the collar.

The valve may include an annular gutter surrounding the bellows, the gutter being located between the bellows and the valve outlet, wherein the gutter is adapted to catch condensation or liquid from an outer surface of the bellows.

The gutter may have a discharge chute being adapted to discharge any liquid from the gutter, the discharge being remote from the valve outlet.

The valve may include a spacer having a flat disc shaped spacer body with an internal passage being adapted to receive the valve body, into which passage there projects locating pins being adapted to abut against the valve body.

A number of spaced tabs may project perpendicularly from the spacer body near to an outer peripheral edge of the spacer body.

The tabs may be etched at discrete intervals to indicate cut-lines at which the tabs are adapted to be cut for altering their height.

The valve may include a seal ring having a disc shaped ring body with an internal passage being adapted to receive the valve body, wherein a number of ridges project from the ring body, thereby to define grooves being adapted to direct flow of liquid.

The ridges may extend radially outwardly from a centre of the ring body.

The grooves may be angled operatively downwardly towards an outer perimeter of the seal ring being adapted to direct flow of liquid accumulated therein towards the outer perimeter.

Also according to the invention, a valve includes a valve body with a valve inlet and a valve outlet; a bellows being joined at one end externally to the valve body between the valve inlet and the valve outlet, the bellows having an annular mounting base for attachment to the valve body; the valve body being provided with an annular flange from which extends an upstanding collar, wherein the mounting base is clamped between the valve body and the collar.

The mounting base may have a width being wider than a gap formed between the valve body and the collar, whereby the mounting base is adapted to be compressed when clamped between the valve body and the collar.

Further according to the invention, a valve includes a valve body with a valve inlet and a valve outlet; a bellows being joined at one end externally to the valve body between the valve inlet and the valve outlet; and an annular gutter surrounding the bellows, the gutter being located between the bellows and the valve outlet, wherein the gutter is adapted to catch condensation or liquid from an outer surface of the bellows.

The gutter may have a discharge chute being adapted to discharge any liquid from the gutter, the discharge being remote from the valve outlet.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
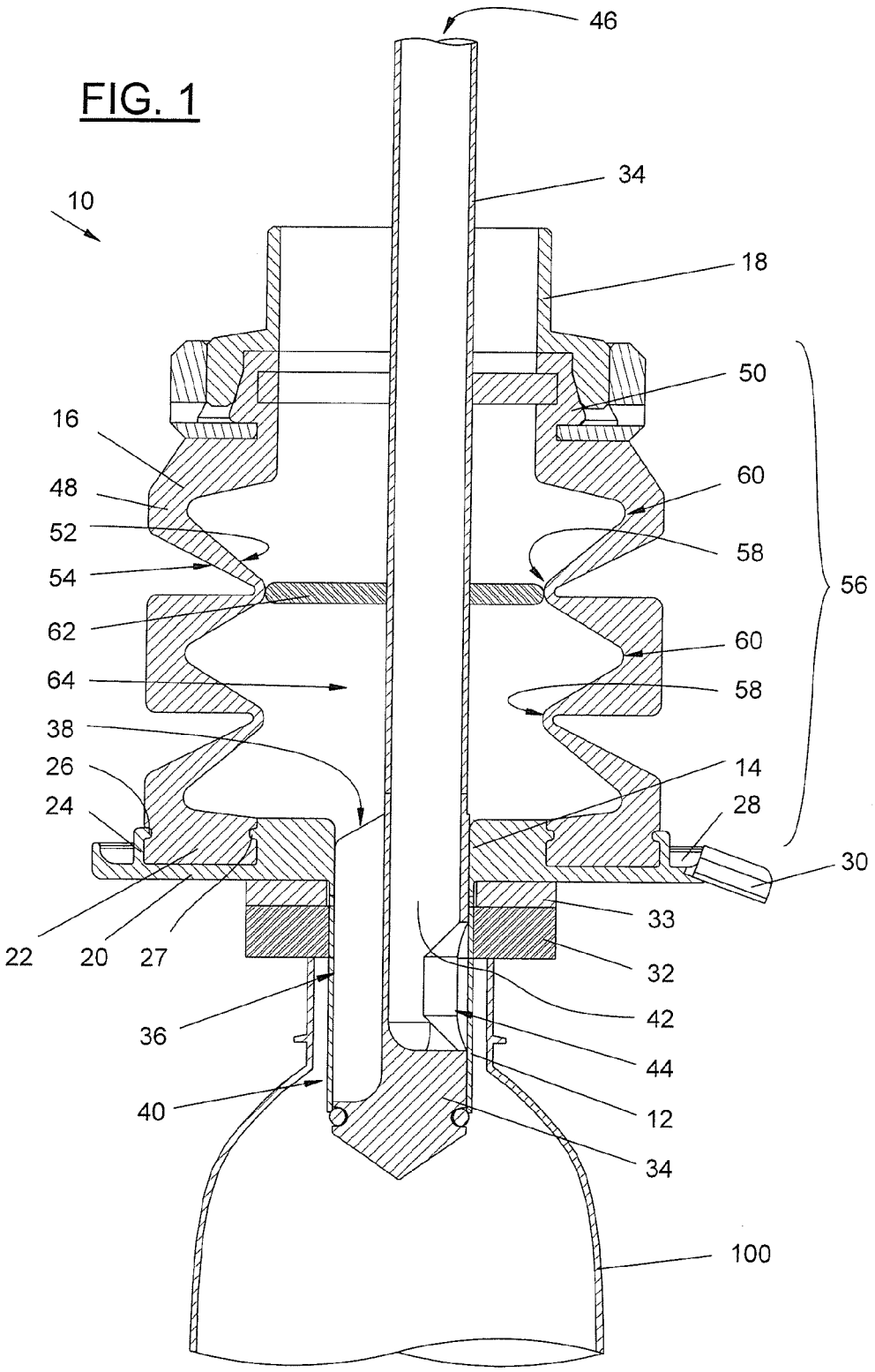
FIG. 1: A sectional side view of a first embodiment of a filling valve according to the invention, shown in a closed position.
Figure 2:
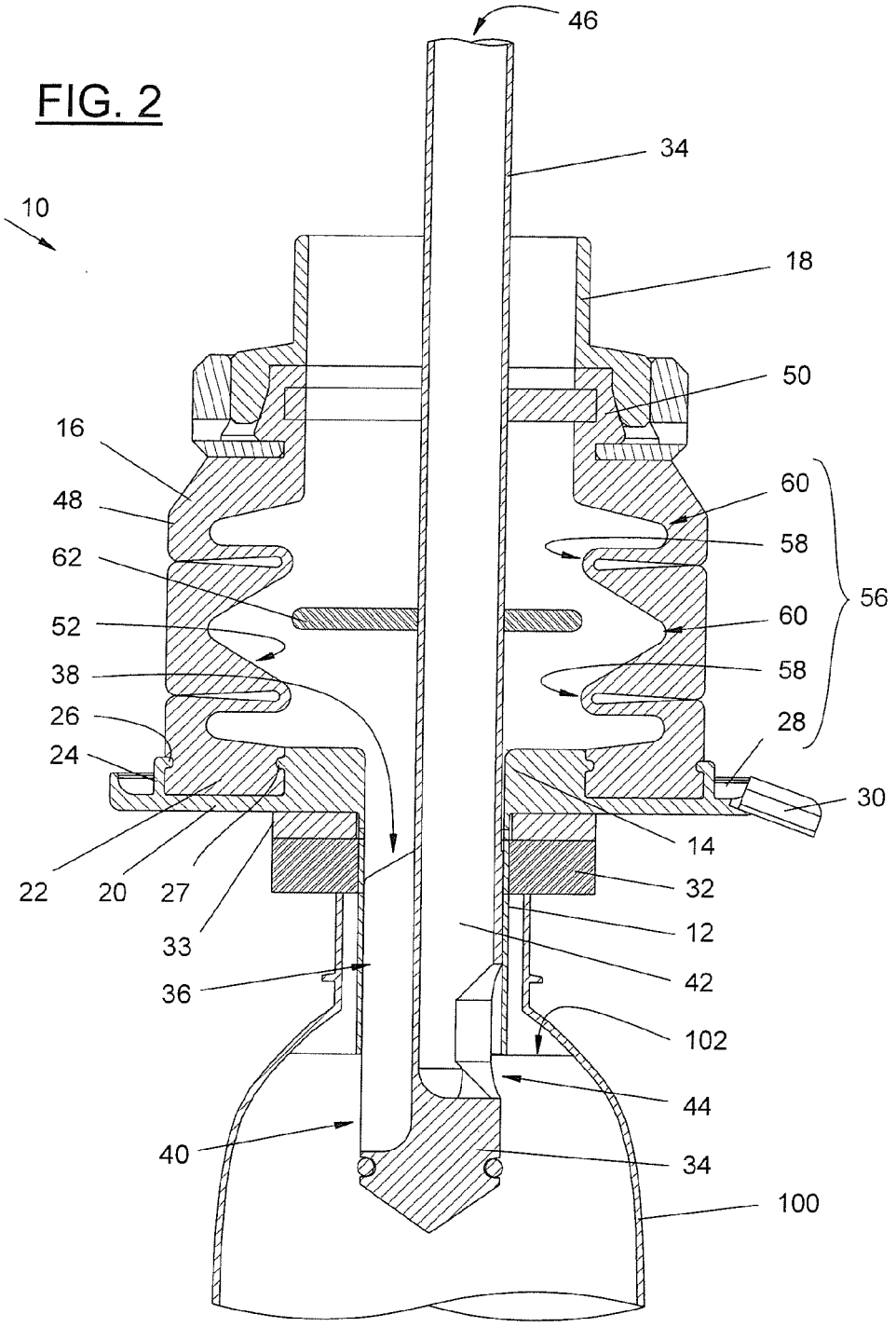
FIG. 2: A sectional side view of the valve of FIG. 1 in an open position.
Figure 3:
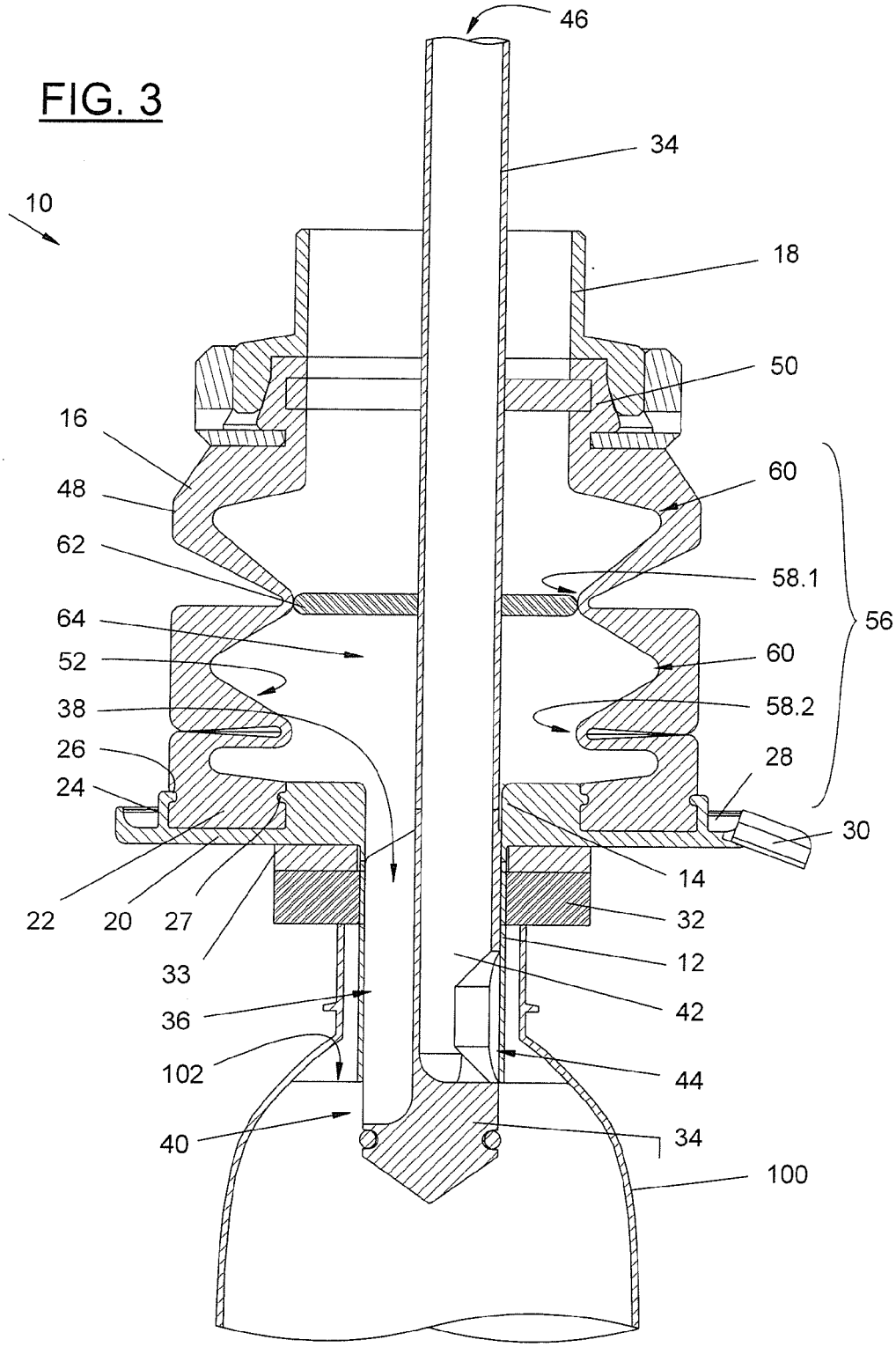
FIG. 3: A sectional side view of the valve of FIG. 1 in a partially open/closed position.

Referring to FIGS. 1 to 3 of the drawings there is shown a first embodiment of a filling valve in accordance with the invention being generally indicated by reference numeral 10. The valve 10 is an automatic level filling valve, as used in rotary or in-line level filling machines for filling a container 100 with a product to a pre-selected level 102.

The valve 10 includes an outer tube 12 which is joined at one end 14 to a resilient flexible compressible hollow bellows 16, with the bellows 16 in turn being joined to a filling tank 18 holding a supply of the product (only the outlet of the filling tank 18 is shown in the drawings). The outer tube 12 has an annular flange 20 abutting against a base 22 of the bellows 16, with a collar 24 projecting from the flange 20 and having a bent off end 26. The collar 24 serves to clamp the bellows base 22 tightly against the outer tube end 14. Preferably the bellows base 22 will have a width being slightly larger than the space between the collar 24 and the outer tube end 14 so that the bellows base 22 is slightly compressed when inserted between the collar 24 and outer tube end 14. The tube end 14 extending into the bellows 16 can optionally have a thicker side wall than the rest of the tube 12 that is remote from the bellows 16, so as to provide additional support for clamping the bellows base 22. An annular ridge 27 surrounds the tube end 14 for cooperation with the bent off end 26 to secure the bellows base 22 between the collar 24 and the tube end 14.

The flange 20 has an annular gutter 28 surrounding the collar 24 with a chute 30 leading from the gutter 28.

A seal ring 32 is located around the outside of the outer tube 12 on a side of the flange 20 opposite to the bellows 16. The position of the seal ring 32 on the outer tube 12 can be regulated by inserting suitable spacers 33 between the seal ring 32 and the flange 20. The spacers 33 thereby regulate the distance that the outer tube 12 projects into the container 100 and consequently the level to which the container 100 will be filled during use.

An inner tube 34 is located within the outer tube 12 so that the outer tube 12 can slide longitudinally relative to the inner tube 34. The inner tube 34 is fixed to be stationary relative to the filling tank 18. The inner tube 34 has an outer diameter at its lower end that is substantially similar to the inner diameter of the outer tube 12 so that they slidingly seal against each other. The inner tube 34 defines a product passage 36 extending through the outer tube 12, with the product passage 36 being in flow communication with the filling tank 18 so that product can flow from the filling tank 18 through the bellows 16 and through the outer tube 12 via the product passage 36. The product passage 36 has a product inlet 38 and a product outlet 40. Leakage of product between the bellows 16 and the outer tube 12 is limited by the tight clamp of the bellows base 22 between the collar 24 and tube end 14.

The inner tube 34 further has a vent passage 42 extending along its length with a vent inlet 44 and a vent outlet 46. The vent inlet 44 is located near to the product outlet 40, while the vent outlet 46 extends beyond product in the filling tank 18 to be open to the ambient environment.

The inner tube 34 is fixed in position relative to the filling tank 18 while the outer tube 12 is adapted to be biased by the bellows 16 to close off the product outlet 40 and the vent inlet 44 of the inner tube 34.

During dispensing use, the container 100 is located beneath the valve 10 so that the outer tube 12 projects into the container 100 while the container mouth contacts against the seal ring 32. By moving the container 100 and valve 10 towards each other, the container 100 presses against the seal ring 32 to overcome the bias of the bellows 16, thereby compressing the bellows 16 and causing the outer tube 12 to slide (upwardly in the drawings) along the inner tube 34 to consecutively open both the product outlet 40 and the vent inlet 44, as is illustrated in FIG. 2. While the container 100 is filled, air inside the container 100 is displaced and exhausted through the vent passage 42. The filling operation stops automatically after the product level 102 in the container 100 reaches the base of the outer tube 12. This is due to the product covering the vent inlet 44, preventing air in the container 100 from exiting through the vent passage 42, and the resultant pressure increase inside the container 100. The container 100 is subsequently lowered, allowing expansion of the bellows 16 to again bias the outer tube 12 to close off the product outlet 40 and the vent inlet 44 of the inner tube 34, as illustrated in FIG. 1, whereafter the container 100 can be replaced by a fresh container for filling.

The bellows 16 has a side wall 48 extending axially from the bellows base 22 and also, distal to the bellows base 22, a mounting rim 50 for attachment of the bellows 16 to the filling tank 18. The side wall 48 has an inner surface 52 and an outer surface 54. A number of concertina formations 56 are formed in the side wall 48 with the concertina formations 56 having annular inner corners 58 and annular outer corners 60. The side wall 48 has a varying thickness along the concertina formations 56 so that the side wall 48 is thinner at its inner corners 58 and thicker at its outer corners 60. The varying thickness serves to strengthen and support the outer corners 60 so that they substantially retain their shape when the bellows 16 is fully compressed, while the necessary deformation required to permit compression of the bellows 16 occurs primarily at the inner corners 58. By focusing the location of the deformation in this way at the inner corners 58, the inner surface 52 of the side wall 48 remains "open" and accessible to prevent any product from being trapped within folds of the compressed concertina formation 56.

A further advantage of the variable side wall thickness of the concertina formation 56 is that the valve 10 can be cleaned in place without the need for removal from the filling machine or dismantling. During a washing cycle the valve 10 is opened and reverse flushed with cleaning fluid, i.e. the cleaning fluid enters through the product outlet 40 and vent inlet 44 and exits into the filling tank 18 and through the vent outlet 46. Due to the inner surface 52 of the bellows 16 remaining fully open and in communication with the flow path of the cleaning fluid, the cleaning fluid is able to come into contact with the entire inner surface 52 of the bellows 16 and also the inside of the vent tube 42.

The strengthened outer corners 60 abut solidly against each other while the bellows 16 is compressed. This prevents further compression of the bellows 16 in a cleaning cycle due to the high pressure of the reverse flowing cleaning fluid and the associated leaking of cleaning fluid at the seal ring 32.

The valve 10 also includes a plug 62 in the form of a circular disc joined to the inner tube 34 within the bellows 16. The plug 62 located on the inner tube 34 at a position whereby the plug 62 is aligned with and seals against the side wall 48 at one of the inner corners 58.1 of the concertina formation 56 when the valve 10 is closed or only partially open (as shown in FIG. 3). The plug 62 thus divides the cavity within the bellows 16 to form a smaller chamber 64 within the bellows 16 between the plug 62 and the bellows base 22. When the valve 10 is fully opened, as shown in FIG. 2, the plug 62 is moved away from the corner 58.1 to be spaced apart from the side wall 48.

The side wall 48 can be manufactured to be stronger along the inner corner 58.1 and weaker along the inner corner 58.2 (see FIG. 3), which can be achieved by making the side wall 48 slightly thicker along the inner corner 58.1 in relation to the inner corner 58.2. During opening compression of the bellows 16, the side wall 48 will thus initially deform and collapse along the inner corner 58.2 and only thereafter will deformation and collapsing occur along the inner corner 58.1 as is illustrated in FIG. 3. Conversely, during closing expansion of the bellows 16, the side wall 48 will first regain its original shape along the inner corner 58.1 before doing so at inner corner 58.2.

The plug 62 does not contact or seal with the side wall 48 while it is deformed along the inner corner 58.1.

While the bellows 16 is only partially compressed with deformation of the side wall 48 only occurring along inner corner 58.2, the vent inlet 44 remains closed by the outer tube 12. The vent inlet 44 is only open while the side wall 48 is deformed along inner corner 58.1.

In use, when the valve 10 is open and the bellows 16 is compressed, the product can flow around the plug 62 through the bellows 16. After the filling operation has stopped the container is lowered away from the valve 10 allowing the bellows 16 to expand. The initial expansion along corner 58.1 causes the plug 62 to seal against the side wall 48 while simultaneously closing off chamber 64 from the filling tank 18. Subsequent further expansion of the bellows 16 along inner corner 58.2 results in an increase in the volume of the chamber 64 and accordingly forming a low pressure therein. This low pressure causes a suction and a small volume of product flows back from the container 100 through the product passage 36 into the chamber 64 before outlet tube 12 closes off vent inlet 44. The volume of product thus taken from the container 100 is not sufficiently large to incorrectly fill the container, but is sufficient to remove any excess product that would otherwise overflow from the container 100 when it resumes its normal shape after reversal of the swelling caused by the head liquid pressure of the filling tank 18.

Often the product being filled through the valve 10 is cooler than ambient temperature, which causes condensation on the outer surface 54 of the bellows 16. This condensation may contain impurities and germs and can form droplets that run down the bellows 16 and drip off the outer tube 12 into the container as the container is being moved into position under the valve 10 before filling or before it is moved away after filling. The gutter 28 collects any such condensation, which is then safely conveyed away via the chute 30.

Figure 4:
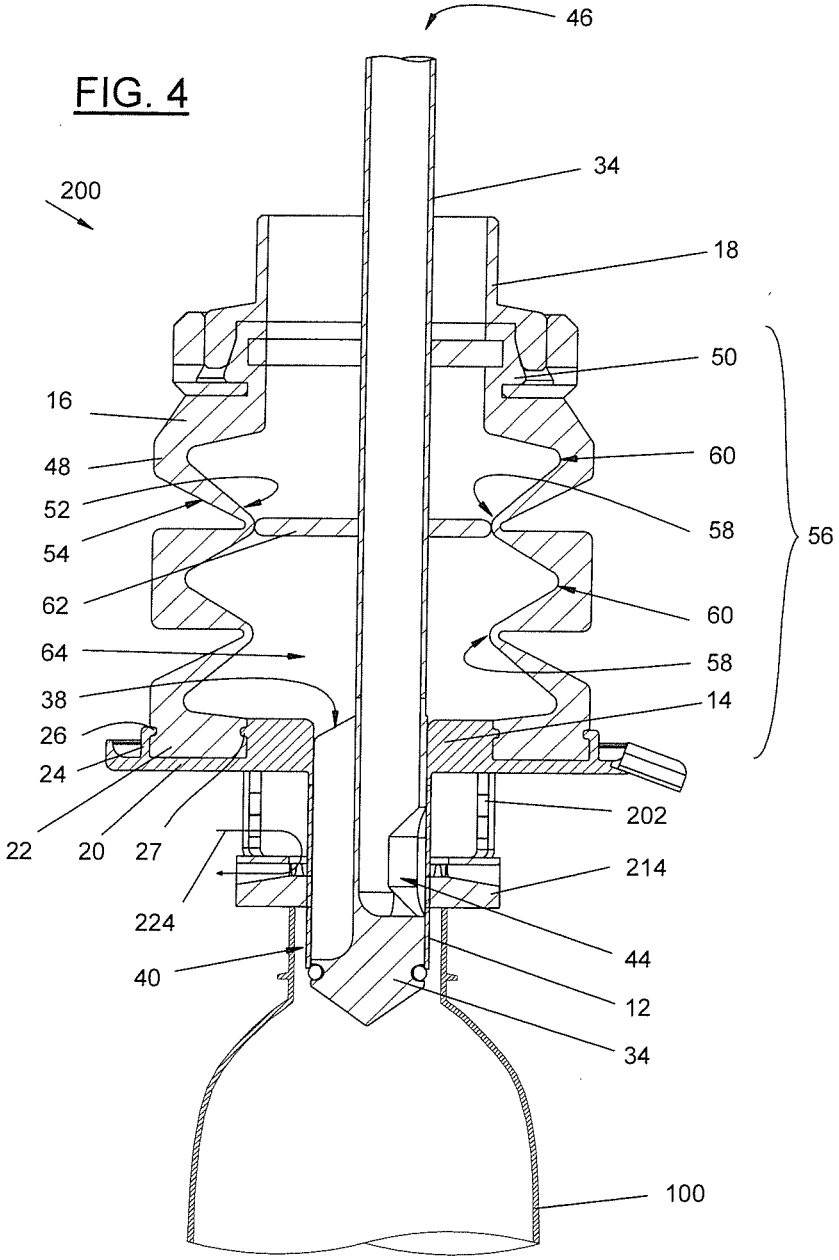
FIG. 4: A sectional side view of a second embodiment of a filling valve according to the invention, shown in a closed position.
Figure 5:
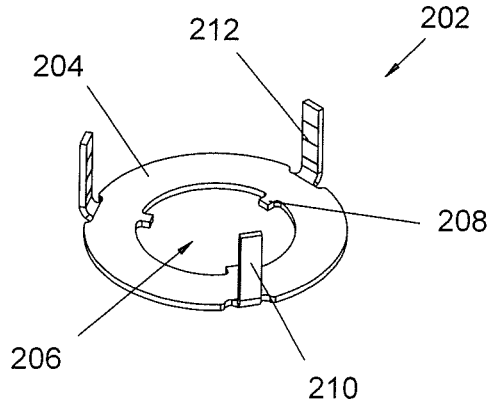
FIG. 5: A perspective view of a spacer provided in the valve shown in FIG. 4.
Figure 6:
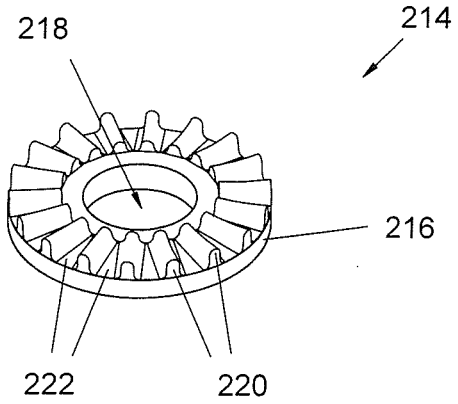
FIG. 6: A perspective view of a seal ring provided in the valve shown in FIG. 4.

Referring now to FIGS. 4 to 6 of the drawings there is shown a second embodiment of a filling valve in accordance with the invention being generally indicated by reference numeral 200. The valve 200 is substantially the same as the valve 10 and similar parts are indicated by the same reference numerals.

The valve 200 has a spacer 202, which is also shown in greater detail in FIG. 5, in lieu of the spacers 33. The spacer 202 has a flat disc shaped body 204 with a passage 206 for receiving the outer tube 12. Locating pins 208 project inwardly into the passage 206 from the body 204 to abut against the outer tube 12 and to centrally locate the outer tube 12 in the passage 206.

Three equidistantly spaced tabs 210 extend from the outer peripheral edge of the body 204. The tabs 210 are bent substantially perpendicularly to the body 204 and are adapted to abut against the flange 20. The tabs 210 are etched 212 at discrete intervals to indicate cut-lines at which the tabs 210 can be cut for altering the height of the spacer 202.

The valve 200 further has a seal ring 214, which is also shown in greater detail in FIG. 6, in lieu of the seal ring 32. The seal ring 214 has a disc shaped body 216 with a passage 218 for receiving the outer tube 12. The seal ring 214 has a number of radially extending ridges 220 and grooves 222 on its upper surface being adapted to abut against the spacer 202 in situ. The grooves 222 are angled downwardly towards the outer perimeter of the seal ring 214 so as to direct flow of liquid accumulated therein away from the outer tube 12.

The tabs 210 and locating pins 208 of the spacer 202 cooperate with the grooves 222 of the sealing ring 214 to form a drain passage (indicated by arrow 224 in FIG. 4) for cleaning liquid during a cleaning cycle.

The invention claimed is:

1. A valve including a valve body with a valve inlet and a valve outlet; a bellows being joined at one end externally to the valve body between the valve inlet and the valve outlet; a plug located transversally inside the bellows, wherein the bellows has an annular side wall formed in a concertina formation with inner and outer corners and wherein the side wall has a non-constant thickness along its length, the side wall being thicker at the outer corners and thinner at the inner corners, the plug being adapted to seal against the side wall when the bellows is fully expanded or partially compressed, the plug further being adapted to be spaced apart from the side wall when the bellows is compressed by more than 40%.

2. A valve as claimed in claim 1, in which the bellows is adapted to be compressed during which major deformation of the concertina formation occurs at the inner corners, while restricted deformation of the concertina formation occurs at the outer corners.

3. A valve as claimed in claim 1, in which the side wall has an inner surface and wherein, during compression of the bellows, no part of the inner surface comes into contact with any other part of the inner surface.

4. A valve as claimed in claim 1, in which the side wall has a substantially rectangular shape outwardly of the outer corners when seen in vertical cross-section.

5. A valve as claimed in claim 1, in which the side wall is adapted to prevent compression of the bellows beyond a pre-selected degree.

6. A valve as claimed in claim 1, in which the plug is a circular disc.

7. A valve as claimed in claim 1, in which the plug is adapted to seat against an inner corner of the concertina formation.

8. A valve as claimed in claim 1, in which the bellows has an annular mounting base for attachment to the valve body; and the valve body has an annular flange from which extends an upstanding collar, wherein the mounting base is clamped between the valve body and the collar.

9. A valve as claimed in claim 8, in which the mounting base has a width being wider than a gap formed between the valve body and the collar, thereby to compress the mounting base when clamped between the valve body and the collar.

10. A valve as claimed in claim 1, which includes an annular gutter surrounding the bellows, the gutter being located between the bellows and the valve outlet, wherein the gutter is adapted to catch condensation or liquid from an outer surface of the bellows.

11. A valve as claimed in claim 10, in which the gutter has a discharge chute being adapted to discharge any liquid from the gutter, the discharge being remote from the valve outlet.

12. A valve as claimed in claim 1, which includes a seal ring having a disc shaped ring body with an internal passage being adapted to receive the valve body, wherein a number of ridges project from the ring body, thereby to define grooves being adapted to direct flow of liquid.

13. A valve as claimed in claim 12, in which the ridges extend radially outwardly from a centre of the ring body.

14. A valve as claimed in claim 12, in which the grooves are angled operatively downwardly towards an outer perimeter of the seal ring being adapted to direct flow of liquid accumulated therein towards the outer perimeter.

15. A valve as claimed in claim 1, which includes a spacer having a flat disc shaped spacer body with an internal passage being adapted to receive the valve body, into which passage there projects locating pins being adapted to abut against the valve body.

16. A valve as claimed in claim 15, in which a number of spaced tabs project perpendicularly from the spacer body near to an outer peripheral edge of the spacer body.

17. A valve spacer as claimed in claim 16, in which the tabs are etched at discrete intervals to indicate cut-lines at which the tabs are adapted to be cut for altering their height.

18. A valve including a valve body with a valve inlet and a valve outlet; a bellows being joined at one end externally to the valve body between the valve inlet and the valve outlet; a plug located transversally inside the bellows, the bellows having an annular mounting base for attachment to the valve body; the valve body being provided with an annular flange from which extends an upstanding collar, wherein the mounting base is clamped between the valve body and the collar, the plug being adapted to seal against a side wall of the bellows when the bellows is fully expanded or partially compressed, the plug further being adapted to be spaced apart from the side wall of the bellows when the bellows is compressed by more than 40%.

19. A valve as claimed in claim 18, in which the mounting base has a width being wider than a gap formed between the valve body and the collar, whereby the mounting base is adapted to be compressed when clamped between the valve body and the collar.

20. A valve including a valve body with a valve inlet and a valve outlet; a bellows being joined at one end externally to the valve body between the valve inlet and the valve outlet; a plug located transversally inside the bellows; and an annular gutter surrounding the bellows, the gutter being located between the bellows and the valve outlet, wherein the gutter is adapted to catch condensation or liquid from an outer surface of the bellows, the plug being adapted to seal against a side wall of the bellows when the bellows is fully expanded or partially compressed, the plug further being adapted to be spaced apart from the side wall of the bellows when the bellows is compressed by more than 40%.

21. A valve as claimed in claim 20, in which the gutter has a discharge chute being adapted to discharge any liquid from the gutter, the discharge being remote from the valve outlet.

* * * * *